US005408901A

United States Patent [19]

Bishop

[11] Patent Number: 5,408,901

[45] Date of Patent: Apr. 25, 1995

[54] VALVE PACKING REMOVAL TOOL

[76] Inventor: Aaron L. Bishop, 8002 Upton Rd., Laingsburg, Mich. 48848

[21] Appl. No.: 290,221

[22] Filed: Aug. 15, 1994

Related U.S. Application Data

[63] Continuation of Ser. No. 820,079, Jan. 13, 1992, abandoned.

[51] Int. Cl.[6] ..... B25B 27/00

[52] U.S. Cl. ..... 81/8.1; 30/502; 408/207

[58] Field of Search ..... 81/8.1, 3.48; 29/213 R, 29/213 E, 270, 278, 157.1 R; 30/388, 502; 408/83.5, 204, 205, 207

[56] References Cited

U.S. PATENT DOCUMENTS

| | | | |
|---|---|---|---|
| 651,267 | 6/1900 | Pickett | 29/278 X |
| 1,655,836 | 1/1928 | Hawkinson . | |
| 1,781,863 | 11/1930 | Shoemaker | 30/388 |
| 2,492,482 | 12/1949 | Kendall | 29/278 X |
| 2,757,452 | 8/1956 | Barnes | 30/388 |
| 3,564,950 | 2/1971 | Jorczak et al. | 29/278 X |
| 3,768,138 | 10/1973 | Trapp | 29/270 |
| 4,096,618 | 6/1978 | Percine et al. | 29/278 |
| 4,226,016 | 10/1980 | Carr . | |
| 4,509,353 | 4/1985 | Smith | 81/8.1 |
| 4,586,857 | 5/1986 | Ohmi | 408/204 X |
| 4,595,321 | 6/1986 | Van Dalen | 408/205 |
| 4,627,165 | 12/1986 | Gibson | 30/502 X |

*Primary Examiner*—James G. Smith
*Attorney, Agent, or Firm*—Ian C. McLeod

[57] ABSTRACT

A packing extractor tool (10 ) for removing packing (27) from a valve assembly (20), is described. The extractor tool is comprised of an arcuate sidewall (11) having an opening (17) that enables the extractor tool to be mounted around a valve stem (25) without removing the handle wheel (37) from the valve stem. One end of the sidewall of the extractor tool is provided with sawblade teeth (13). The other end of the sidewall has a handle (15) that enables the extractor tool to be rotated around the valve stem to that the sawblade teeth can cut into and disintegrate the packing. A distal portion (15B) of the handle can be angled upward which helps a user apply a downward force to the extractor tool so that the sawblade teeth can penetrate into and disintegrate the packing.

38 Claims, 2 Drawing Sheets

VALVE PACKING REMOVAL TOOL

This is a continuation of application Ser. No. 07/820,079 filed on Jan. 13, 1992, now abandoned.

BACKGROUND OF THE INVENTION

1. Field of the Invention

The present invention relates to an extraction tool that can be used for removing packing from the stuffing box of a valve. The extraction tool of the present invention is particularly useful for removing packing from around a circular cross-sectional valve shaft mounted in the stuffing box of a manually operated fluid control valve. The extraction tool is comprised of a main, generally cylindrical working member having a sidewall with a plurality of cutting teeth at the perimeter of one of the open ends of the working member. A handle extends laterally from the other open end of the working member. An arcuate opening is provided in the sidewall and extends between the open ends of the working member. The arcuate opening is preferably only slightly wider than the diameter of the valve shaft. This provides for positioning the extraction tool on the valve shaft without having to remove the valve handle wheel from the valve shaft. The extraction tool is then rotated about the valve shaft so that the cutting teeth bite into the packing to pulverize the packing surrounding the valve shaft. The arcuate opening also acts as a conduit for removing the pulverized packing from the stuffing box. Thus, the extraction tool is a reliable and an easy to use tool that is particularly useful for removing old and worn packing from the stuffing box of a valve so that the packing can be replaced before fluids controlled by the valve leak past the packing.

The extraction tool is also useful for removing packing from around a shaft means mounted in a housing where the shaft means reciprocates inside the housing. An example of this would be a reciprocating pump shaft or a reciprocating lance tube and stuffing box that are concentrically mounted around a feed tube as in a furnace. In those embodiments where the shaft means is actuated in a reciprocating motion, the shaft means need not necessarily have a circular cross-section, but instead can also have a polygonal cross-section perpendicular to the longitudinal axis of the shaft means.

2. Description of the Prior Art

The prior art has described various types of tools that are useful for removing packing material from around shafts, such as those found in fluid control valves. Most of these packing extractor tools have cutting elements that are formed as augers, picks or corkscrews. In the removal process, the cutting element is forced to bore into the packing material. The extractor tool is then manipulated to disintegrate and clean the packing material from between the valve stem and the stuffing box holding the packing material.

The problem with a great many of the prior art packing extraction tools is that they require that the valve handle wheel be removed from the valve stem so that the extractor tool can be mounted on the valve stem. Removing the valve handle wheel can be time consuming and difficult if the valve is located in an area of limited accessibility. Illustrative of this type of packing extractor tool are U.S. Pat. Nos. 1,195,220 to Hendren; 2,822,713 to Schmidt; 3,014,271 to Englund and 4,226,016 to Carr.

U.S. Pat. No. 3,149,514 to Shaub describes a packing extractor having a yoke that breaks down into two halves to enable the yoke to be assembled around a valve stem. The yoke is then threaded onto bolts that are normally used to hold a compression nut against the packing. A number of corkscrews are provided on the yoke. The corkscrews are rotated to worm into the packing. The yoke is then backed away from the stuffing box. This causes the corkscrews to pull the packing out of the stuffing box. The problem with this device is that if the packing is brittle and worn, the corkscrews may not be able to cleanly remove all of the packing from the stuffing box. In that case, the remaining packing will need to be cleaned from the stuffing box by a separate tool.

Other types of packing extractors have also been described that do not require the valve handle wheel to be removed from the valve stem. However, these extractors are more complicated than the extractor tool of the present invention or they require that the valve be in a relatively accessible area.

U.S. Pat. No. 3,443,460 to Johnston, Jr. describes a packing extractor tool that is comprised of an open helix having a handle. The helix is able to be mounted on a valve stem without removing the valve handle wheel. The helix can then be manipulated to peel the packing out of the stuffing box. This requires that the tool be rotated around the valve stem through several rotations, which means that the valve must be in a relatively accessible area. As the extractor tool is being rotated about the valve stem, a cutting edge of the helix digs into the packing. The cutting edge, however, has a tendency to bury in the packing and to thus become lodged. The extractor tool must then be worked back and forth to dislodge the helix from the packing.

U.S. Pat. No. 3,651,717 to Johnston, Jr. describes a packing extractor tool that is formed as an open helix. One end of the helix is attached to a breakdown coupling that can be mounted on a valve stem without the need to remove the valve handle wheel from the valve stem. A spanner wrench is used with the coupling to bore the helix into packing material. This device has many parts and is complicated to assemble. Also, a cutting edge of the helix tends to become lodged or buried in the packing as the helix digs into the packing in the stuffing box. This requires that the helix be worked back and forth to dislodge the extractor tool from the packing.

U.S. Pat. No. 4,509,392 to Smith describes a packing extractor that is formed in the shape of a pair of opposed levers joined by a fulcrum. The levers form a handle that when compressed separates the opposite ends of the levers to force a cutting projector, mounted on one of the levers, into the valve packing. The extractor must be braced against a valve hand wheel or some similar stop mechanism and requires numerous thrusts into the packing to dislodge the packing. Also, the downward thrust of the cutting projection may actually tend to compress some of the packing tighter into the stuffing box.

U.S. Pat. No. 4,611,510 to Morton describes a packing removal tool that is particularly adapted for use with feed tubes for a soot blower. The packing removal tool is mounted on a feed tube, and as a lance tube and its stuffing box are retracted from the furnace, a cutting edge of the tool digs into the packing in the stuffing box. This packing removal tool is not particularly suitable for use with a manually operated valve.

What is not shown by the prior art and what is needed is a packing extractor tool that can be mounted on the valve shaft of a manually operated valve without having to disassemble the valve handle wheel. The packing extractor tool must also be provided with cutting teeth that scrape at the packing without becoming lodged in the packing as the packing is removed from the stuffing box. This prevents damaging the valve shaft and the stuffing box as the extractor tool is being manipulated and rotated around the valve shaft to disintegrate and pulverize the packing.

OBJECTS

It is therefore an object of the present invention to provide a packing extractor tool that can be mounted around a valve shaft of a valve to remove packing from a valve stuffing box without removing the valve handle wheel from the valve shaft. Further, it is an object of the present invention to provide a packing extraction tool that is able to be mounted around a valve shaft without removing the valve handle wheel from the valve shaft and that has a plurality of cutting teeth that can be worked against the packing to pulverize and disintegrate the packing from the stuffing box, without scoring the valve shaft. It is also an object of the present invention to provide a packing extraction tool comprised of a generally cylindrical working member having an arcuate opening that enables the working member to be positioned around the valve shaft of a manually operated valve without disassembling the valve handle wheel and wherein the extraction tool has a plurality of cutting teeth for pulverizing packing from the stuffing box. Finally, it is an object of the present invention to provide a packing extraction tool that is inexpensive to manufacture, can be positioned around a valve shaft without removing the valve handle wheel from the valve shaft and that is easy to use for pulverizing and removing packing from a valve stuffing box. These and other objects will become increasingly apparent by reference to the following description and to the drawings.

DESCRIPTION OF THE PREFERRED EMBODIMENTS

Figure 1:
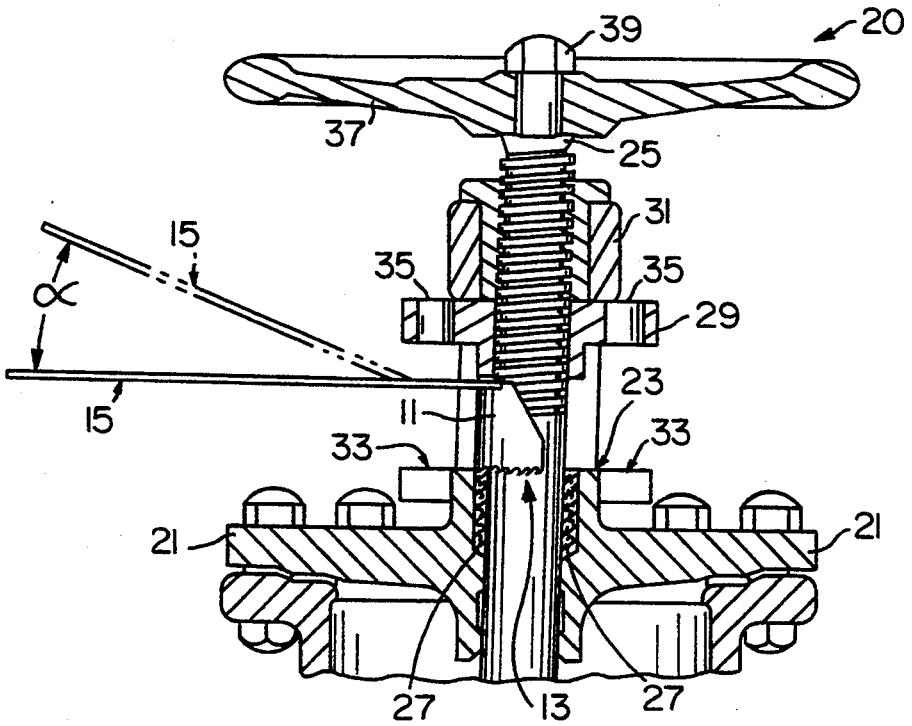
FIG. 1 is a partial cross-section view of a manually operable valve assembly 20 with a compression nut 29 removed from the valve bonnet 21 so that the packing extraction tool 10 of the present invention can be mounted around the valve shaft 25 for removing packing 27 from a stuffing box 23

The present invention relates to a packing extraction tool for removing packing surrounding a valve stem of a valve means, which comprises: a body member to be mounted around the valve stem, the body member having a sidewall between opposed open ends along and around a first longitudinal axis of the body member, wherein the sidewall has an opening between the open ends that enables the body member to be moved in a lateral direction towards the valve stem to mount the body member concentrically around a second longitudinal axis of the valve stem; a cutting means formed at a periphery of the sidewall and around a first one of the open ends of the body member; and actuating means for providing rotational and axial movement to the body member to provide for rotating the body member about the second axis of the valve stem, wherein the body member is able to be advanced axially along the second axis of the valve stem so that the cutting means is able to penetrate and disintegrate the packing surrounding the valve stem.

Further, the present invention relates to a packing extraction tool for removing packing surrounding a valve stem of a valve means, which comprises: a body member to be mounted around the valve stem, the body member having a sidewall between opposed open ends along and around a first longitudinal axis of the body member, wherein the sidewall has an opening between the open ends that enables the body member to be moved in a lateral direction towards the valve stem to mount the body member concentrically around a second longitudinal axis of the valve stem; a cutting means formed at a periphery of the sidewall and around a first one of the open ends of the body member; and actuating means for providing rotational and axial movement to the body member to provide for rotating the body member about the second axis of the valve stem, wherein the body member is able to be advanced axially along the second axis of the valve stem so that the cutting means is able to penetrate and disintegrate the packing surrounding the valve stem.

Still further, the present invention relates to a method for removing packing from around a shaft means that is mounted in a housing means using a packing extraction tool, which comprises the steps of: providing the packing extraction tool comprised of: a body member having a sidewall between opposed open ends along and around a first longitudinal axis of the body member, wherein the sidewall has an opening between the open ends that enables the body member to be moved in a lateral direction towards the shaft means to mount the body member concentrically around a second longitudinal axis of the shaft means; a cutting means formed at a periphery of the sidewall and around a first one of the open ends of the body member; and actuating means for providing rotational and axial movement to the body member; moving the body member in the lateral direction towards the shaft means to mount the body member on the shaft means through the opening in the sidewall so that the body member is positioned concentrically around the second longitudinal axis of the shaft means; and manipulating the actuating means to rotate the body member around the second axis of the shaft means while simultaneously advancing the body member axially along the second axis to enable the cutting means to penetrate and disintegrate the packing surrounding the shaft means mounted in the housing means.

Finally, the present invention relates to a method for removing packing from around a valve stem of a valve means using a packing extraction tool, which comprises the steps of: providing the packing extraction tool comprised of: a body member having a sidewall between opposed open ends along and around a first longitudinal axis of the body member, wherein the sidewall has an opening between the open ends that enables the body member to be moved in a lateral direction towards the valve stem to mount the body member concentrically around a second longitudinal axis of the valve stem; a cutting means formed at a periphery of the sidewall and around a first one of the open ends of the body member; and actuating means for providing rotational and axial movement to the body member; moving the body member in the lateral direction towards the valve stem to mount the body member on the valve stem through the opening in the sidewall so that the body member is positioned concentrically around the second longitudinal axis of the valve stem; and manipulating the actuating means to rotate the body member around the second axis of the valve stem while simultaneously advancing the body member axially along the second axis to enable the cutting means to penetrate and disintegrate the packing surrounding the valve stem of the valve means.

Figure 4:
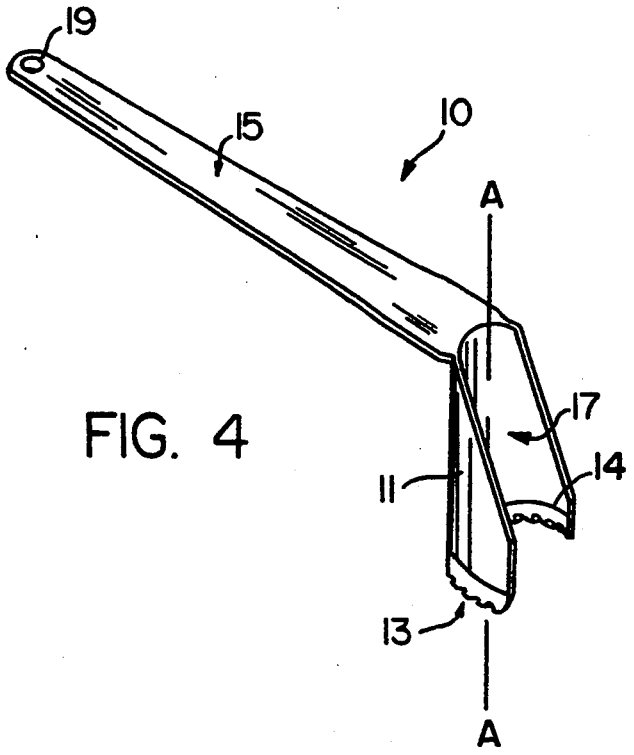
FIG. 4 is a perspective view of the packing extraction tool 10 shown in FIG. 1 and showing the handle 15 and the working member 11 made of a different material than the cutting teeth 13 as shown by line 14.

The extraction tool can be a unitary tool made from a metal material, a metal alloy material or a ceramic material. The extraction tool can also be made from a composite of materials (FIG. 4). In this case, the handle and the working member could be made of one material and the cutting teeth made of another material as shown by line 14. Alternately, the handle could be made of one material, and the working member and the cutting teeth of another material. Also, the handle, the working member and the cutting teeth could be made of different materials.

Figure 3:
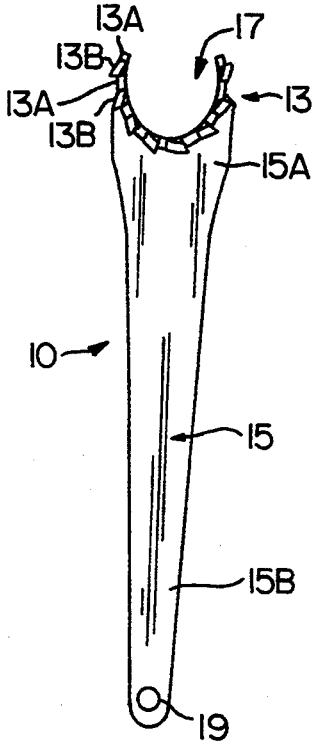
FIG. 3 is a bottom plan view of the packing extraction tool 10 shown in FIG. 1 and showing the sawblade teeth 13 and handle 15.
Figure 2:
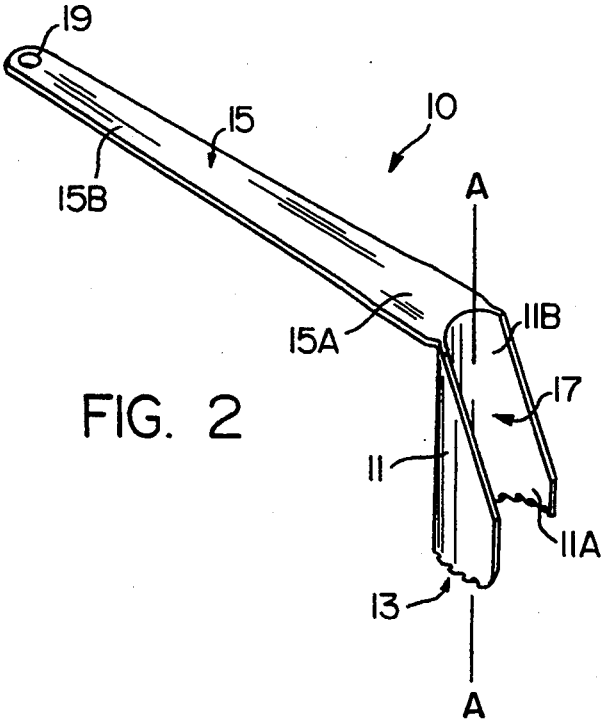
FIG. 2 is a perspective view of the packing extraction tool 10 shown in FIG. 1 and showing the arcuate sidewall 11 with opening 17, which provides for mounting the extraction 10 around the valve shaft 25.

FIGS. 1 to 3 show the packing extractor tool 10 of the present invention. The packing extractor tool 10 is comprised of a sidewall 11 that forms a main body member having a plurality of sawblade teeth 13 at a lower end 11A and a handle 15 extending from an upper end 11B of the sidewall 11.

As shown in FIG. 1, the packing extractor tool 10 is utilized in association with a manually operable valve assembly, indicated generally at 20. The valve assembly 20 includes a valve bonnet portion 21 having a packing recess or stuffing box 23 through which projects a rotary, or a rotary and reciprocating valve operating stem or shaft 25. The extractor tool 10 of the present invention is also useful for removing packing from around a reciprocating shaft (not shown) or for removing packing such as is commonly found in a furnace having a reciprocating lance tube and stuffing box mounted concentrically around a feed tube (not shown).

Within the stuffing box 23 is packing 27, which can be comprised of split-rings or rope types packing. The packing 27 is preferably made of an elastomeric or asbestos material. The valve 20 further includes a packing compression nut 29 and a valve handle bridge 31. The compression nut 29 is retained on the valve bonnet 21 by bolts (not shown) that mount through openings 33 in the valve bonnet 21 and through openings 35 in the compression nut 29. The bolts are then threadably mated with nuts (not shown) to secure the compression nut 29 on the valve bonnet 21. This serves to compress the packing 27 so that the packing 27 surrounds the valve shaft 25 in a tight fit to hold back fluids including liquids and gases controlled by the valve 20. The valve 20 also includes a handle wheel 37 that is removeably, but non-rotatably retained on the valve shaft 25 by nut 39 to effect operation, in a conventional manner, of a valve element (not shown).

Referring in greater detail to the preferred embodiment of the packing extractor tool 10 shown in FIGS. 2 and 3, the sidewall 11 of the extractor tool 10 has an arcuate shape between the lower and upper ends 11A and 11B, and around the longitudinal axis A—A of the sidewall 11. Starting at a distance spaced above the lower end 11A, the arcuate extent of the sidewall 11 decreases as the sidewall 11 extends axially along the axis A—A to the upper end 11B to form an arcuate opening 17 in the sidewall 11. The opening 17 has an arcuate extent measured from the axis A—A of between about 80 to 180 degrees. As shown in FIG. 1, the arcuate opening 17 enables the extractor tool 10 to be mounted on the valve shaft 25 without requiring the handle wheel 37 to be removed from the valve shaft 25.

The lower end 11A of the sidewall 11 is provided with sawblade teeth 13, which extend around the arcuate perimeter of the lower end 11A and that serve as a cutting means for the extractor tool 10. As particularly shown in the bottom plan view in FIG. 3, the sawblade teeth 13 are angled in a counterclockwise direction. As viewed from above the valve 20 looking down, when the extractor tool 10 is turned in a clockwise direction, the angled sawblade teeth 13 dig and cut into the packing 27 to disintegrate the packing 27. The sawblade teeth 13 are further comprised of first sawblade teeth 13A that extend radially around the longitudinal axis A—A, a similar distance from the axis A—A as the sidewall 11 and second sawblade teeth 13B that are angled outwardly, away from the longitudinal axis A—A. Preferably, every other cutting tooth is angled.

The handle 15 is mounted to the upper end 11B of the sidewall 11 and is used to impart rotational movement to the body member. As shown in FIGS. 1 to 3, the handle 15 is a planar member that extends from the upper end 11B of the sidewall 11, perpendicular to the axis A—A. As shown in phantom in FIG. 1, another embodiment of the handle 15 is comprised of a proximal section 15A, mounted to the upper end 11B of the sidewall 11 and a distal section 15B. The proximal section 15A is mounted to the sidewall 11 along a plane perpendicular to the longitudinal axis A—A of the sidewall 11. The distal section 15B extends from the proximal section 15A, spaced above the sidewall 11. That way, the distal section 15B preferably extends from the proximal section 15A along a plane that forms an arcuate angle alpha with the plane of the proximal section 15A. The angle alpha of the distal section 15B is preferably between 10 and 15 degrees. This enables a user of the extractor tool 10 to apply a force having a downward component that is of a sufficient magnitude to enable the sawblade teeth 13 to cut into the packing 27 as the extractor tool 10 is rotated around the valve stem 25. The handle 15 is also provided with an opening 19 that provides for hanging the extractor tool 10 on a hook (not shown) or other similar hanger device. The handle 15 can also be provided with a stiff rib (not shown) that extends the length of the handle 15. The stiff rib serves to provide stability to the handle 15 during use of the extractor tool 10.

IN USE

The packing extractor tool 10 of the present invention is useful for removing packing 27 from the stuffing box 23 in the valve 20. Before the packing 27 can be removed; however, the packing compression nut 29 must be unbolted from the valve bonnet portion 21. The packing compression nut 29 is then slid axially along the valve shaft 25, towards the handle wheel 37, where it is temporarily secured while the packing 27 is being removed.

With the packing compression nut 29 removed from the valve bonnet 21, the user grasps the handle 15 and moves the extractor tool 10 towards the valve shaft 25. The opening 17 in the sidewall 11 enables the extractor tool 10 to slip over the valve shaft 25 so that the sidewall 11 mounts around the valve shaft 25. Preferably the radius of the sidewall 11 is only slightly larger than that of the valve shaft 25. In this position, the extractor tool 10 is mounted concentrically around the valve shaft 25 so that the sidewall 11 is in a closely spaced relationship with the valve shaft 25. The extractor tool 10 is then moved so that the sawblade teeth 13 contact the packing 27 and the handle 15 is rotated clockwise around the valve shaft 25, as viewed from above the valve 20, looking down. This enables the sawblade teeth 13, which are also angled in the clockwise direction, to dig into the packing 27. In the second embodiment of the handle 15 (shown in phantom in FIG. 1), the angled distal portion 15B of the handle 15 helps the user to apply a downward force component of a sufficient magnitude to cause the sawblade teeth 13 to dig into and disintegrate the packing 27. As shown in FIG. 1, for increased downward force, the compression nut 29 can be positioned on the upper end 11B of the sidewall 11 with the sawblade teeth 13 contacting the packing 27. Force can then be applied to the compression nut 29 to help the sawblade teeth 13 penetrate into the packing 27.

The alternating angled and unangled sawblade teeth 13A and 13B enable the extractor tool 10 to penetrate into the packing 27 in a cut that is wider than the cross-sectional thickness of the sidewall 11. Also, the sawblade teeth 13B, which are angled away from the valve shaft 25, prevent the extractor tool 10 from scoring or scratching the valve shaft 25. Scoring and scratching marks are injurious to the proper operation of the valve 20, since they provide sources of possible leakage of fluids along and through the scratch or score marks.

Once the packing 27 has been completely dug and disintegrated from the stuffing box 23, the extractor tool 10 is removed from around the valve shaft 25. Any repairs that are needed can now be performed on the valve 20. New packing 27 is then packed into the stuffing box 23 as is well known to those skilled in the art before the compression nut 29 is resecured on the valve bonnet 21.

Besides the handle 15 as an actuating means for the packing extractor tool 10, it is contemplated by the scope of the present invention that the extractor tool 10 could be rotated around and along the longitudinal axis of the valve shaft 25 by a motor means (not shown). The extractor tool 10, with or without the handle 15, could be mounted on the motor means and then both the motor means and the extractor tool 10 could be mounted on the valve shaft 25. The motor means would then be actuated to rotate the extractor tool 10 around the longitudinal axis of the valve shaft 25, while advancing the extractor tool 10 axially along the valve shaft 25 as the packing 27 is pulverized and disintegrated from the stuffing box 23 and from around the valve shaft 25.

It should be mentioned that besides being useful for removing packing from around the circular cross-sectioned valve stem 25, the extractor tool 10 is also useful for removing packing from around shaft means which have polygonal cross-sections. In this case, the shaft means would not be able to rotate in the packing 27, but instead would reciprocate in the packing in alternating forwards and backwards directions. Examples of this type of shaft means are shown in a reciprocating pump or a reciprocating lance tube and stuffing box that are concentrically mounted around a feed tube as in a furnace. In that case, the extractor tool 10 would be mounted on the feed tube and moved towards the lance tube and stuffing box to remove the packing from the stuffing box.

The extractor tool 10 can also be provided with a removeable cover (not shown) that mounts over the sawblade teeth 13 at the lower end 11A of the sidewall 11. The cover would serve as a safety device to protect the sawblade teeth 13 when the extractor tool 10 is not being used. The cover would also serve to sheath the sawblade teeth 13 so that the extractor tool 13 can be used to mount and to compress the packing 27 in the stuffing box 23.

It is intended that the foregoing description be only illustrative of the present invention and that the present invention be limited only by the hereinafter appended claims.

I claim:

1. A packing extraction tool for removing packing surrounding a shaft that is mounted in a housing means for the shaft, which comprises:

(a) a body member to be mounted around the shaft, the body member having an arcuate sidewall between opposed open ends along and around a longitudinal axis of the body member, wherein the sidewall has an opening extending between the open ends that enables the body member to be moved in a direction lateral to a longitudinal axis of the shaft, towards the shaft to mount all of the body member concentrically around the longitudinal axis of the shaft so that the longitudinal axis of the shaft and body member are aligned;

(b) a cutting means having sawblade teeth formed at a periphery of the sidewall and extended around a first one of the open ends of the body member; and (c) actuating means for providing rotational and axial movement to the body member to provide for rotating the body member about the axis of the shaft, wherein the body member is able to be advanced axially along the axis of the shaft so that the cutting means is able to penetrate and disintegrate the packing surrounding the shaft.

2. The packing extractor tool of claim 1 wherein the body member is shaped for use with the shaft which has a circular cross-section perpendicular to the longitudinal axis of the shaft.

3. The packing extractor tool of claim 1 wherein the body member is dimensioned for use wherein the shaft is rotatably mounted in the housing means and wherein the shaft has a handle wheel for rotating the shaft, without disassembly.

4. The packing extractor tool of claim 1 wherein the body member is dimensioned for use wherein the shaft has a reciprocating movement with respect to the housing means, without disassembly.

5. The packing extractor of claim 1 wherein the sidewall of the body member has a generally circular cross-section along the longitudinal axis of the body member.

6. The packing extractor of claim 5 wherein the opening along the sidewall has an arcuate extent of between about 80 and 180 degrees.

7. The packing extractor of claim 1 wherein the sawblade teeth are curved towards a direction of rotation of the body member about the shaft.

8. The packing extractor of claim 7 wherein at least some of the teeth are angled radially outwardly away from the longitudinal axis of the body member so that when the body member is rotated around the shaft to penetrate and disintegrate the packing surrounding the shaft, the teeth do not score the shaft.

9. The packing extractor of claim 1 wherein the actuating means is a handle for grasping the device that extends from the body member in a position perpendicular to the longitudinal axis of the body member.

10. The packing extractor of claim 9 wherein the handle extends from the body member at a second one of the open ends of the body member.

11. The packing extractor of claim 1 wherein the actuating means is a handle for grasping the device having a proximal portion that extends from the second open end of the body member along a plane perpendicular to the longitudinal axis of the body member and a distal portion, wherein the distal portion of the handle extends from the proximal portion along a plane forming an acute angle with the plane of the proximal portion and spaced away from the body member.

12. The packing extractor of claim 11 wherein the distal portion of the handle forms an angle of between about 10 and 15 degrees with a plane of the proximal portion of the handle.

13. The packing extractor of claim 1 made as a unitary tool from a metal material, a metal alloy material or a ceramic material.

14. The packing extractor of claim 1 made of metal materials or metal alloy materials.

15. A packing extraction tool for removing packing surrounding a valve stem of a valve assembly with a manually operable handle wheel for moving the valve stem, without disassembly, which comprises:

(a) a body member to be mounted around the valve stem, the body member having an arcuate sidewall between opposed open ends along and around a longitudinal axis of the body member, wherein the sidewall has an opening extending between the open ends that enables the body member to be moved in a direction lateral to a longitudinal axis of the stem, towards the valve stem to mount all of the body member concentrically around the longitudinal axis of the valve stem so that the longitudinal axis of the stem and body member are aligned;

(b) a cutting means having sawblade teeth formed at a periphery of the sidewall and extended around a first one of the open ends of the body member; and (c) actuating means for providing rotational and axial movement to the body member to provide for rotating the body member about the axis of the valve stem, wherein the body member is able to be advanced axially along the axis of the valve stem so that the cutting means is able to penetrate and disintegrate the packing surrounding the valve stem.

16. The packing extractor of claim 15 wherein the body member is shaped for use with the valve stem which has a circular cross-section perpendicular to the longitudinal axis of the valve stem.

17. The packing extractor of claim 15 wherein the sidewall of the body member has a generally circular cross-section along the longitudinal axis of the body member.

18. The packing extractor of claim 17 wherein the opening along the sidewall has an arcuate extent of between about 80 and 180 degrees.

19. The packing extractor of claim 15 wherein the sawblade teeth are curved towards a direction of rotation of the body member about the valve stem.

20. The packing extractor of claim 19 wherein at least some of the teeth are angled radially outwardly away from the longitudinal axis of the body member so that when the body member is rotated around the valve stem to penetrate and disintegrate the packing surrounding the valve stem, the teeth do not score the valve stem.

21. The packing extractor of claim 15 wherein the actuating means is a handle for grasping the device that extends from the body member in a position perpendicular to the longitudinal axis of the body member.

22. The packing extractor of claim 21 wherein the handle extends from the body member at a second one of the open ends of the body member.

23. The packing extractor of claim 15 wherein the actuating means is a handle for grasping the device having a proximal portion that extends from the second open end of the body member along a plane perpendicular to the longitudinal axis of the body member and a distal portion, wherein the distal portion of the handle extends from the proximal portion along a plane forming an acute angle with the plane of the proximal portion and spaced away from the body member.

24. The packing extractor of claim 22 wherein the distal portion of the handle forms an angle of between about 10 and 15 degrees with a plane of the proximal portion of the handle.

25. The packing extractor of claim 15 made as a unitary tool from a metal material, a metal alloy material or a ceramic material.

26. The packing extractor of claim 15 made of metal materials or metal alloy materials.

27. A method for removing packing from around a shaft that is mounted in a housing means using a packing extraction tool, which comprises the steps of:

(a) locating adjacent the shaft the packing extraction tool comprised of: a body member having an arcuate sidewall between opposed open ends along and around a longitudinal axis of the body member, wherein the sidewall has an opening extending between the open ends that enables the body member to be moved in a direction lateral to a longitudinal axis of the shaft, towards the shaft to mount all of the body member concentrically around the longitudinal axis of the shaft; a cutting means having sawblade teeth formed at a periphery of the sidewall and extended around a first one of the open ends of the body member; and actuating means for providing rotational and axial movement to the body member so that the longitudinal axis of the shaft and body member are aligned;

(b) moving the body member in the direction lateral to the longitudinal axis of the shaft, towards the shaft to mount the body member on the shaft through the opening in the sidewall so that the body member is positioned concentrically around the longitudinal axis of the shaft; and (c) manipulating the actuating means to rotate the body member around the axis of the shaft while simultaneously advancing the body member axially along the axis of the shaft to enable the cutting means to penetrate and disintegrate the packing surrounding the shaft mounted in the housing means.

28. The method of claim 27 wherein the step of locating the packing extractor tool includes using a packing extractor tool wherein the body member is dimensioned for use wherein the shaft is rotatably mounted in the housing means and wherein the shaft has a handle wheel for rotating the shaft, without disassembly.

29. The method of claim 27 wherein the step of locating the packing extractor tool includes using a packing extractor tool wherein the body member is dimensioned for use wherein the shaft has a reciprocating movement with respect to the housing means, without disassembly.

30. The method of claim 27 wherein the sawblade teeth are curved around the longitudinal axis of the body member, towards a direction of rotation of the body member around the shaft for rapidly removing the packing upon rotation of the tool around the shaft.

31. The method of claim 30 wherein at least some of the teeth of the cutting means are angled radially outwardly away from the longitudinal axis of the body member to penetrate and disintegrate the packing surrounding the shaft without scoring the shaft during rotation of the body member around the shaft.

32. The method of claim 27 wherein the step of manipulating the actuating means includes using a handle extending from the body member in a position perpendicular to the longitudinal axis of the body member as the actuating means for rotating the body member around the shaft.

33. The method of claim 27 wherein the step of manipulating the actuating means includes using a handle having a proximal portion that extends from the second open end of the body member along a plane perpendicular to the axis of the body member and a distal portion, wherein the distal portion of the handle extends from the proximal portion along a plane forming an acute angle with the plane of the proximal portion and spaced away from the body member as the actuating means for rotating the body member to remove the packing from around the shaft.

34. A method for removing packing from around a valve stem of a valve assembly having a manually operable handle wheel for moving the valve stem, without disassembly, using a packing extraction tool, which comprises the steps of:

(a) locating adjacent the valve stem the packing extraction tool comprised of: a body member having an arcuate sidewall between opposed open ends along and around a longitudinal axis of the body member, wherein the sidewall has an opening extending between the open ends that enables the body member to be moved in a direction lateral to a longitudinal axis of the valve stem, towards the valve stem to mount all of the body member concentrically around the longitudinal axis of the valve stem; a cutting means having sawblade teeth formed at a periphery of the sidewall and extended around a first one of the open ends of the body member; and actuating means for providing rotational and axial movement to the body member so that the longitudinal axis of the stem and body member are aligned;

(b) moving the body member in the lateral direction towards the valve stem to mount all of the body member on the valve stem through the opening in the sidewall so that all of the body member is positioned concentrically around the longitudinal axis of the valve stem; and (c) manipulating the actuating means to rotate all of the body member around the axis of the valve stem while simultaneously advancing the body member axially along the axis of the valve stem to enable the cutting means to penetrate and disintegrate the packing surrounding the valve stem of the valve.

35. The method of claim 34 wherein the sawblade teeth are curved around the longitudinal axis of the body member, towards a direction of rotation of the body member around the valve stem for rapidly removing the packing upon rotation of the tool around the valve stem.

36. The method of claim 35 wherein at least some of the teeth of the cutting means are angled radially outwardly away from the longitudinal axis of the body member to penetrate and disintegrate the packing surrounding the valve stem without scoring the valve stem durinq rotation of the body member around the valve stem.

37. The method of claim 34 wherein the step of manipulating the actuating means includes using a handle extending from the body member in a position perpendicular to the longitudinal axis of the body member as the actuating means for rotating the body member around the valve stem.

38. The method of claim 34 wherein the step of manipulating the actuating means includes using a handle having a proximal portion that extends from the second open end of the body member along a plane perpendicular to the axis of the body member and a distal portion, wherein the distal portion of the handle extends from the proximal portion along a plane forming an acute angle with the plane of the proximal portion and spaced away from the body member as the actuating means for rotating the body member to remove the packing from around the valve stem.

* * * * *

UNITED STATES PATENT AND TRADEMARK OFFICE

CERTIFICATE OF CORRECTION

PATENT NO. : 5,408,901

DATED : April 25, 1995

INVENTOR(S) : Aaron L. Bishop

It is certified that error appears in the above-indentified patent and that said Letters Patent is hereby corrected as shown below:

Title page, Column 2, line 1, "Percine" should read --Perline--.

Title page, Column 2, line 3, "4,509,353" should read --4,509,392--.

Column 3, line 53, after "extraction", --tool-- should be inserted.

Column 12, line 34 (Claim 36), "durinq" should read --during--.

Signed and Sealed this

Fifteenth Day of August, 1995

Bruce Lehman

*Attest:*

BRUCE LEHMAN

*Attesting Officer*

*Commissioner of Patents and Trademarks*